US009536689B2

(12) United States Patent
Noh et al.

(10) Patent No.: US 9,536,689 B2
(45) Date of Patent: Jan. 3, 2017

(54) MULTI-OPERATING SWITCH UNIT FOR VEHICLES

(71) Applicant: DAESUNG ELECTRIC CO., LTD, Ansan-si, Gyeonggi-do (KR)

(72) Inventors: Sam Jong Noh, Incheon (KR); Jung Han Kim, Siheung-si (KR); Sang Ku Yun, Ansan-si (KR); Sung Kyoung Kim, Ansan-si (KR)

(73) Assignee: DAESUNG ELECTRIC CO., LTD, Ansan-si, Gyeonggi-do (KR)

( * ) Notice: Subject to any disclaimer, the term of this patent is extended or adjusted under 35 U.S.C. 154(b) by 15 days.

(21) Appl. No.: 14/651,637

(22) PCT Filed: Dec. 10, 2013

(86) PCT No.: PCT/KR2013/011409
§ 371 (c)(1),
(2) Date: Jun. 11, 2015

(87) PCT Pub. No.: WO2014/092433
PCT Pub. Date: Jun. 19, 2014

(65) Prior Publication Data

US 2015/0318128 A1 Nov. 5, 2015

(30) Foreign Application Priority Data

Dec. 12, 2012 (KR) ..... 10-2012-0144796
Apr. 22, 2013 (KR) ..... 10-2013-0044104
Dec. 10, 2013 (KR) ..... 10-2013-0153002

(51) Int. Cl.
*H01H 19/00* (2006.01)
*H01H 25/06* (2006.01)
(Continued)

(52) U.S. Cl.
CPC ..... *H01H 25/06* (2013.01); *G05G 9/047* (2013.01); *G05G 9/04792* (2013.01);
(Continued)

(58) Field of Classification Search
CPC ..... H01H 25/041; H01H 25/04; H01H 25/00; H01H 25/008; H01H 25/06; H01H 2025/048; H01H 2221/012
(Continued)

(56) References Cited

U.S. PATENT DOCUMENTS 4,330,694 A * 5/1982 Ogawa ..... G05G 9/04792 200/6 A
6,762,372 B2 * 7/2004 Nishimoto ..... H01H 25/041 200/18
(Continued)

FOREIGN PATENT DOCUMENTS

JP 2009-016114 A 1/2009
JP 3157281 U 1/2010
(Continued)

*Primary Examiner* — Vanessa Girardi
(74) *Attorney, Agent, or Firm* — Rabin & Berdo, P.C.

(57) ABSTRACT

Provided is a multi-operating switch unit for vehicles including: a housing part; a substrate; a switch shaft part; a rotary switch part; a directional switch part; and a push switch part. The directional switch part has: a directional slide part in which the position thereof can vary in the housing part due to a tilting directional operation of the switch shaft part; a directional switch that is arranged on the substrate and is operated due to the positional variation of the directional slide part; and a directional return part that returns the directional slide part and the switch shaft part. The directional return part has a return plunger; a return elastic part; and a return groove. The return plunger can be movable in
(Continued)

the axial length direction of the switch shaft part with respect to the housing part, and the return groove is formed in the directional slide part.

19 Claims, 15 Drawing Sheets

(51) Int. Cl.

| | |
|---|---|
| ***H01H 13/50*** | (2006.01) |
| ***H01H 13/04*** | (2006.01) |
| ***H01H 19/04*** | (2006.01) |
| ***H01H 21/04*** | (2006.01) |
| ***H01H 25/04*** | (2006.01) |
| ***G05G 9/047*** | (2006.01) |
| *H01H 19/11* | (2006.01) |

(52) U.S. Cl.
CPC ..... *G05G 9/04796* (2013.01); *H01H 13/04* (2013.01); *H01H 13/50* (2013.01); *H01H 19/04* (2013.01); *H01H 21/04* (2013.01); *H01H 25/04* (2013.01); *G05G 2009/04744* (2013.01); *G05G 2009/04777* (2013.01); *G05G 2009/04781* (2013.01); *H01H 19/11* (2013.01); *H01H 2025/046* (2013.01); *H01H 2025/048* (2013.01); *H01H 2231/026* (2013.01); *H01H 2235/01* (2013.01)

(58) Field of Classification Search
USPC ..... 200/4, 6 A
See application file for complete search history.

(56) References Cited

U.S. PATENT DOCUMENTS

| | | | | |
|---|---|---|---|---|
| 7,310,084 | B2 * | 12/2007 | Shitanaka | H01H 25/04 200/5 A |
| 8,039,767 | B2 * | 10/2011 | Saomoto | G05G 5/05 200/18 |
| 8,283,583 | B2 * | 10/2012 | Asada | H01H 25/06 200/4 |
| 9,048,046 | B2 * | 6/2015 | Yamazaki | H01H 25/04 |
| 2009/0008233 | A1 | 1/2009 | Saomoto | |

FOREIGN PATENT DOCUMENTS

| | | | |
|---|---|---|---|
| KR | 10-2008-0066601 | A | 7/2008 |
| KR | 10-2011-0032600 | A | 3/2011 |
| KR | 10-1091273 | B1 | 12/2011 |
| KR | 10-1096925 | B1 | 12/2011 |
| KR | 10-2012-0039188 | A | 4/2012 |

* cited by examiner

MULTI-OPERATING SWITCH UNIT FOR VEHICLES

TECHNICAL FIELD

The present invention relates to a switch installed in a vehicle, and more particularly, to a vehicular switch which implements a combined operation thereof through a simple and compact structure.

BACKGROUND ART

In general, a steering wheel assembly for vehicles includes a steering wheel, a steering column, a steering roll connector assembly, and a multi-function switch assembly. The steering wheel is intended to allow a driver to set the steering direction. The rotation of the steering wheel by the driver is transferred to vehicle wheels through the steering column so that the steering angle of the vehicle is set. In addition, a vehicle such as an automobile requires functions of various kinds of convenient means for offering a more stable and comfortable driving state, beyond a function of the vehicle as a means of transportation.

For example, the steering wheel of a vehicle which is recently produced includes a window switch for opening or closing a window, a steering light switch for turning on or off a steering light, an audio switch for driving an audio device, and a wiper switch for driving a wiper. The multi-function switch assembly includes a light and a fog lamp, a wiper, various audio devices, and a vehicle window switch, and the like. The multi-functional switch assembly serves to prevent the driver's driving attention from being dissipated even during manipulation of a wide variety of devices by increasing the manipulability of the various devices. The multi-functional switch assembly is implemented as a button switch mounted on a top of the steering wheel, or a vehicular lever switch mounted on a side of the steering wheel. Further, various functions are concentrated on a console switch.

The switch of the vehicle follows a recent trend toward an intensive combination of switches having various functions. The structure of the vehicular switch becomes more complicated in proportion to an increase in functions of the switch, thus leading to an increase in the possibility of erroneous operation of the switch.

DISCLOSURE OF INVENTION

Technical Problem

Accordingly, the present invention has been made to solve the above-mentioned problems occurring in the prior art, and it is an object of the present invention to provide a multi-operating switch device for a vehicle, which can implement a combined operation thereof through a simple and compact structure so that durability can be enhanced and a more accurate operation can be achieved.

Technical Solution

To achieve the above object, the present invention provides a multi-operating switch device for a vehicle, including: a housing unit; a substrate disposed within the housing unit; a switch shaft unit movably disposed so as to be received at one end thereof in the housing unit and exposed at the other end thereof to the outside; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the directional switch unit includes: a directional slide part configured to be changed in position within the housing unit by the tilting directional operation of the switch shaft unit; a directional switch disposed on the substrate, and configured to be operated by a change in the position of the directional slide part to generate a signal indicating the change in the position of the directional slide part; and a directional return switch configured to return the directional slide part and the switch shaft unit to their original positions on a plane, wherein the directional return switch includes: a return plunge movably disposed in the housing unit; a return elastic part received in the housing unit and configured to elastically support the return plunger; and a return groove configured to form a continuous contact with the return plunger and including a position for returning the return plunger to its original position, and wherein the return plunger is movable in an axial direction of the switch shaft unit with respect to the housing unit, and the return groove is formed in the directional slide part.

In the multi-operating switch device for a vehicle, the housing unit may include; a housing base configured to support the substrate; and a housing cover engaged with the housing base to define an inner space therebetween, and including a return mounting part formed thereon to allow the return plunger to be movably disposed at the return mounting part.

In the multi-operating switch device for a vehicle, the direction slide part may include: a directional medium slide disposed between the housing base 130 and the housing cover in such a manner that the switch shaft unit penetrates through the direction medium slide; a directional bottom slide disposed between the directional medium slide and the housing base in such a manner as to penetratingly fit around the outer periphery of switch shaft unit; and a directional top slide formed on one surface of the housing cover so as to be oriented toward the directional medium slide and configured to be engaged with the directional medium slide in a relatively movable manner.

In the multi-operating switch device for a vehicle, the directional medium slide may include: a medium upper guide formed on one surface thereof so as to be engageable with the direction top slide; and a medium lower guide formed on the other surface thereof so as to be engageable with a bottom guide formed on the directional bottom slide in a relatively movable manner.

In the multi-operating switch device for a vehicle, the directional bottom slide may include: a bottom slide body including the bottom guide formed on one surface thereof, and having a bottom through-hole formed at the center thereof to allow the switch shaft unit to penetrate therethrough in such a manner that the bottom through-hole is in close contact at the inner peripheral surface thereof with the switch shaft unit; a bottom slide side formed extending outwardly from a side of the bottom slide body and having the return groove formed thereon; and a bottom slide moving part formed below the bottom slide body and configured to move the directional switch.

In the multi-operating switch device for a vehicle, the medium upper guide and the medium lower guide may be arranged so as to cross each other at 90 degree angles on the same plane when viewed from the top by projection.

In the multi-operating switch device for a vehicle, the return groove may include: a groove stable portion configured to form a contact with a lower end of the return plunger in a normal state in which no external force is applied to the switch shaft body; and a groove moving portion is disposed at the outside of the groove stable portion so that when an external force is applied to the switch shaft unit to cause the switch shaft body the groove moving portion forms a contact with the lower end of the return plunger.

In the multi-operating switch device for a vehicle, the bottom slide moving part may be a projection formed protrudingly extending downwardly from the underside of the bottom slide body, and the direction switch may be a contact switch.

In the multi-operating switch device for a vehicle, the switch shaft unit may include: a switch shaft hinge disposed at one end thereof so as to be hingeably received within the housing unit and including a shaft hinge guide formed on the outer periphery thereof; and a switch shaft body of a predetermined length connected to the switch shaft hinge and configured to be exposed at one end thereof to the outside from the housing unit, and wherein the rotary switch unit may include: a rotary encoder disposed between the substrate and the housing unit and configured to at least partially receive the switch shaft hinge, the rotary encoder including a rotary encoder receiving guide formed on the inner periphery thereof so as to be engageable with the shaft hinge guide and a plurality of rotary encoder slits formed on the outer periphery thereof; and a rotary switch sensor disposed on the substrate so as to be spaced apart from the rotary encoder by a predetermined interval and including a rotary switch sensor configured to detect the number of movements of the rotary encoder slits when the rotary encoder is axially rotated together with the switch shaft unit.

In the multi-operating switch device for a vehicle, the rotary switch unit may further include a rotary detent part configured to detent the rotation of the rotary encoder.

In the multi-operating switch device for a vehicle, the rotary detent part may include: a rotary detent disposed on the underside of the rotary encoder; a rotary detent elastic means received in a rotary detent receiving part disposed in the housing unit; and a rotary detent ball elastically supported by the rotary detent elastic means to maintain a continuous contact with the rotary detent.

In the multi-operating switch device for a vehicle, the rotary detent part may include: a rotary detent disposed on a side of a lower portion of the rotary encoder; a leaf spring type rotary detent elastic means fixedly mounted to the housing unit to correspond to the rotary detent; and a rotary detent elastic protrusion formed integrally with the rotary detent elastic means so as to be bently protruded from the center of the rotary detent elastic means to maintain a continuous contact with the rotary detent.

In the multi-operating switch device for a vehicle, the rotary detent part may include: a rotary detent disposed on a side of a lower portion of the rotary encoder; a rotary detent elastic means received in a rotary detent receiving part disposed radially in the housing unit so as to be oriented toward the center of the switch shaft unit; and a rotary detent ball elastically supported by the rotary detent elastic means to maintain a continuous contact with the rotary detent.

In the multi-operating switch device for a vehicle, the push switch unit may include: a push detent disposed on an upper end of the rotary detent at a side of the lower portion of the rotary encoder to form a stacked-layer structure together with the rotary detent in a longitudinal direction of the switch shaft unit and a radial direction from the center of the switch shaft unit; a push moving part at least partially disposed on the rotary encoder, and configured to be vertically moved downwardly together with the rotary encoder when the switch shaft hinge of the switch shaft unit presses the rotary encoder to downwardly move the rotary encoder; and a push switch disposed on the substrate and configured to generate a signal indicating the change in the position of the push moving part When the push moving part is changed in position in a vertical direction.

In the multi-operating switch device for a vehicle, the rotary detent receiving part guide may further include a chamfered part formed at an upper end thereof, which is oriented toward the center of the housing unit to prevent an undesirable interference with the rotary encoder when the rotary encoder is vertically moved.

In the multi-operating switch device for a vehicle, the push switch unit may include: a push holder at least partially disposed below the rotary encoder and configured to be in close contact with the switch shaft hinge of the switch shaft unit so that when the switch shaft unit is vertically moved, the push holder is vertically moved together with the switch shaft unit; a push switch disposed on the substrate and configured to generate a signal indicating a change in position of the push holder when the push holder is changed in the position in a vertical direction; and a push return part disposed below the push holder and configured to elastically support the push holder.

In the multi-operating switch device for a vehicle, the push holder may include: a holder body configured to contactingly receive the switch shaft hinge; a holder extension formed extending outwardly from a side of the holder body; and a holder moving part formed upwardly extending from the holder extension in parallel with a vertical movement direction of the switch shaft unit so that when the switch shaft unit is vertically moved, the holder moving part moves the push switch.

In the multi-operating switch device for a vehicle, the push return part may include: a push return body configured to be in close contact with the holder body; a push return extension formed extending outwardly from a side of the push return body; and a push return rubber cap disposed on one surface of the push return extension and configured to elastically support the holder extension.

In the multi-operating switch device for a vehicle, each of the holder body and the push return body may include a through-hole formed at the center thereof, wherein the switch shaft hinge may include a shaft hinge stopper at a bottom surface thereof, wherein the housing unit may include a base push tolerance formed at a bottom surface thereof to correspond to the shaft hinge stopper, wherein when an external force may be applied to the switch shaft unit to perform a push operation, the shaft hinge stopper is received in the base push tolerance, and wherein when an external force is applied to the switch shaft unit to perform a tilting operation, the shaft hinge stopper may be brought into close contact with an outer surface of the base push tolerance to prevent from the shaft hinge stopper being received in the base push tolerance.

Advantageous Effects

The multi-operating switch device for a vehicle according to the embodiments of the present invention as constructed above have the following advantageous effects.

The multi-operating switch device is mounted at a steering wheel or a console switch device of the inside of a vehicle so that a combined operation can be implemented to select or control the electrical operation of a navigation device, an audio multimedia device, and an air conditioner of the vehicle, which are used in the inside of the vehicle.

In addition, the multi-operating switch device for a vehicle of the present invention minimizes the number of constituent elements and concentrates a switch sensor and the like on a single substrate to minimize a problem associated with an electrical wiring and thus improve a degree of freedom of design and assemblability, thereby reducing the manufacturing cost due to improvement of productivity.

Moreover, the multi-operating switch device for a vehicle of the present invention can minimize a mounting space through a compact configuration or a partition of an arrangement region of various operations, and prevent or minimize the possibility of erroneous operation of the switch due to interference between the constituent elements.

Further, the multi-operating switch device for a vehicle of the present invention can minimize an angle at which the switch shaft body can rotate about the switch shaft hinge for operation of the directional switch unit to prevent occurrence of an interference due to a contact with the knob and the housing unit to minimize the spaced distance between the knob and the housing unit and thus prevent foreign substances from being introduced into the directional switch unit through the through-hole or the like, through a structure in which the switch shaft hinge is disposed below the directional slide part, i.e., the switch shaft hinge is disposed at a lower portion of the housing unit and the directional slide part and the directional switch are disposed at a position higher than the rotary switch unit and the push switch unit. In addition, the possibility of interference between the knob and the housing unit can be prevented or decreased so that the constituent elements can be designed in a compact manner.

Furthermore, the multi-operating switch device for a vehicle of the present invention can implement the push operation through the rotary detent part so that the number of parts and the manufacturing cost can be reduced and a compact configuration can be implemented.

BRIEF DESCRIPTION OF THE DRAWINGS

The above and other objects, features and advantages of the present invention will be apparent from the following detailed description of the preferred embodiments of the invention in conjunction with the accompanying drawings, in which.

BEST MODE FOR CARRYING OUT THE INVENTION

Figure 1:
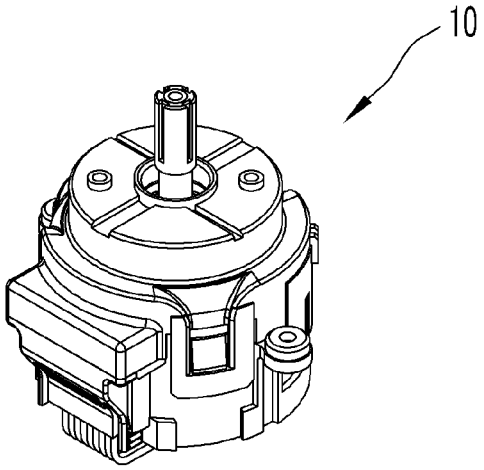
FIG. 1 is a schematic perspective view illustrating a multi-operating switch device for a vehicle according to an embodiment of the present invention.
Figure 2:
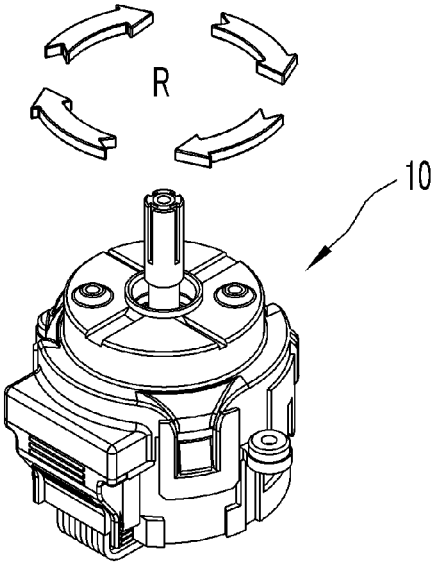
FIG. 2 is a schematic perspective view illustrating the rotary operation state of a multi-operating switch device for a vehicle according to an embodiment of the present invention.
Figure 3:
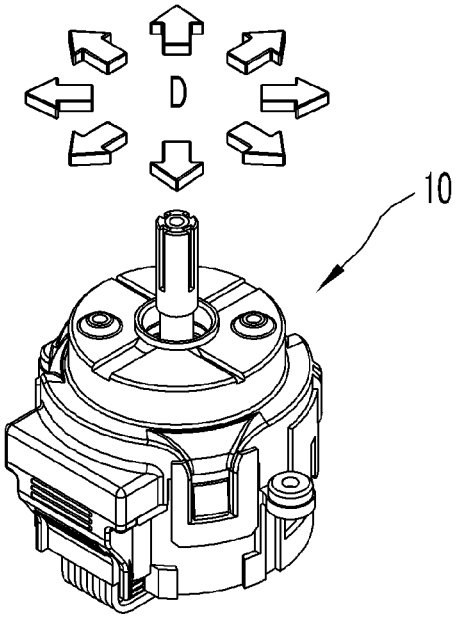
FIG. 3 is a schematic perspective view illustrating the directional tilting operation state of a multi-operating switch device for a vehicle according to an embodiment of the present invention.
Figure 4:
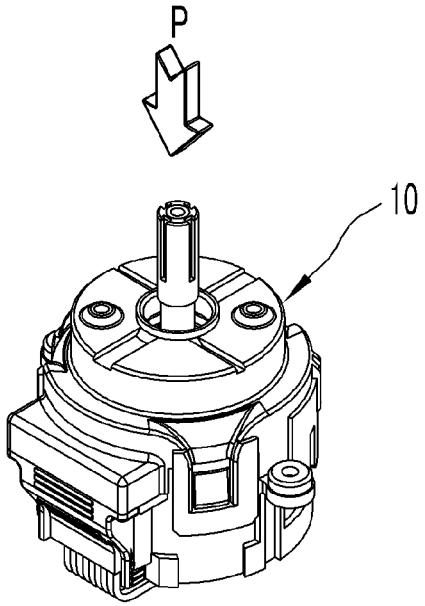
FIG. 4 is a schematic perspective view illustrating the push operation state of a multi-operating switch device for a vehicle according to an embodiment of the present invention.

Now, preferred embodiments of the present invention will be described hereinafter in detail with reference to the accompanying drawings. It should be noted that the same elements in the drawings are denoted by the same reference numerals although shown in different figures. In the following description, the detailed description on known function and constructions unnecessarily obscuring the subject matter of the present invention will be avoided hereinafter.

A multi-operating switch device 10 for a vehicle in accordance with the present invention includes a housing unit 100, a substrate 200, a switch shaft unit 300, a rotary switch unit 400, a directional switch unit 500, and a push switch unit 600. The multi-operating switch device 10 for a vehicle in accordance with the present invention is a switch device that is used in a vehicle. The switch device enables the implementation of various manipulation states thereof so that it is used to control various functions of the vehicle, for example, the operation states of a wide range of electrical and electronic devices for a vehicle such as an audio device, a navigator, an air-conditioner The housing unit 100 includes a housing cover 110 and a housing base 130. The housing cover 110 and the housing base 130 are engaged with each other to define an inner space therebetween. The housing base 130 forms a structure that supports the substrate 200, and the housing cover 110 is engaged with the housing base 130 to define the inner space therebetween. The housing cover 110 includes a through-hole 111 formed on one surface thereof to allow one end of the switch shaft unit 300 which will be described later to be exposed to the outside through the through-hole 111 so that a manipulation force of a user such as a driver can be provided.

In this embodiment, the housing unit 100 further includes a housing holder 120. The housing holder 120 is disposed between the housing cover 110 and the housing base 130. The housing holder 120 can serve to support the substrate 200 together with the housing base 130, and divides the inner space defined by the housing cover 110 and the housing base 130 so that a space dividing function can be performed which prevents an interference from occurring upon the operation of the rotary switch unit 400 and the directional switch unit 500, which will be described later.

The substrate 200 is disposed within the housing unit 100. Various electric elements can be disposed on the substrate 200. The electric elements may be electrically connected to each other through a wiring formed on the substrate 200. Alternatively, the electric elements may have a structure that establishes an electrical communication by means of other elements, for example, a flexible substrate and a cable. In this embodiment, the substrate 200 is implemented as a double-sided substrate so that various elements can be disposed on both sides thereof.

The substrate 200 has a through-hole 202 formed at the center thereof so that the switch shaft unit 300 can be disposed penetratingly in the substrate through the through-hole 202. The substrate 200 is formed at one end thereof with a substrate connector 201. A connector 203 is connected to the substrate connector 201 so that the substrate 200 can be electrically connected to an external electrical device such as, for example, a control unit (not shown) through the connector 203.

The switch shaft unit 300 has a structure in which it is received at one end thereof in the housing unit 100 and is exposed at the other end thereof to the outside. The switch shaft unit 300 includes a switch shaft body 310 and a switch shaft hinge 320. The switch shaft body 310 is implemented as a rod type member having a predetermined length, and the switch shaft hinge 320 is disposed at one end of the switch shaft body 310 so as to be received within the housing unit 100. Although not shown in this embodiment, a switch knob (not shown) is mounted at an end of the switch shaft body 310, which is exposed to the outside to make a grip of a driver smooth so that a certain sense of manipulation can be provided to the driver.

The switch shaft hinge 320 connected to a lower end of the switch shaft body 310 has a spherical shape in this embodiment, and may have a modified shape depending on a detailed design specification. The switch shaft hinge 320 forms a rotation center of the switch shaft unit 300. The switch shaft hinge 320 is disposed in a space defined by the housing holder 120 and a rotary encoder receiving part 411 (see FIG. 5) formed in a rotary encoder 410 of the rotary switch unit 400 which will be described later. The switch shaft hinge 320 has a structure in which the switch shaft body 310 is disposed penetratingly through a through-hole 121 formed on the housing holder 120.

Thus, the switch shaft body 310 can implement a combined operation of an axial rotation thereof, a tilting movement thereof about the switch shaft hinge 320 by application of a horizontal pressing force, and a press and push movement thereof in which the switch shaft body 310 is pressed downwardly.

The switch shaft hinge 320 functioning as a rotation center point for the directional tilting movement of the switch shaft body 310 according to this embodiment is positioned between the housing unit and the substrate, specifically between the substrate 200 and the housing base 130, more specifically between the housing holder 120 disposed below the substrate 200 and the housing base 130. The directional switch unit 500 has a structure in which it is disposed between the substrate 200 and the housing cover 110 so as to be spaced apart from the switch shaft hinge 320 serving as the rotation center of the switch shaft body 310 so that the directional tilting movement of the switch shaft body 310 required to move a directional switch 560 of the directional switch unit 500 disposed above the switch shaft hinge 320 can be minimized to minimize the spaced distance between the directional switch unit 500 and the housing cover, thereby preventing foreign substances from being introduced into the directional switch unit 500 through the housing cover.

Figure 17:
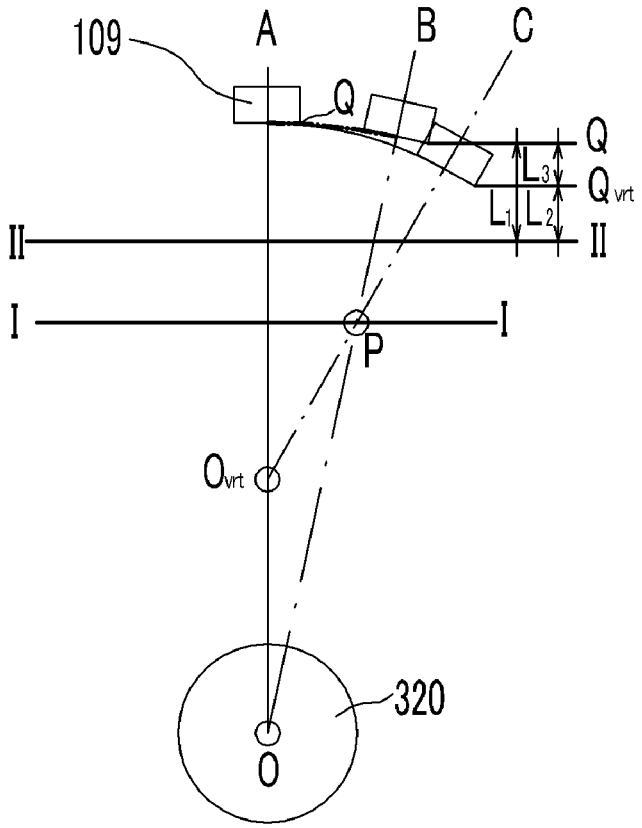
FIG. 17 is a state view illustrating the directional tilting operation process of a multi-operating switch device for a vehicle according to an embodiment of the present invention.

In other words, FIG. 17 illustrates the state view of the switch shaft body 310 and the switch shaft hinge 320 that implement the directional tilting operation. In FIG. 17, a knob 109 is disposed at an end of the switch shaft body 310. In a normal state, the switch shaft body is disposed on a line O-A. When it is assumed that a position for moving the directional switch 560 into the directional tilting operation state of the switch shaft body of the present invention is a point P on a line I-I, the length of the switch shaft body 310 until the switch shaft body 310 reaches the position P exists on a line O-B. At this point, the end of the knob 109 occupies a position indicated by a reference symbol Q.

On the contrary, unlike the structure of the present invention, if the switch shaft hinge occupies a virtual center point Ovrt, the switch shaft body is positioned on a line Ovrt-C until the switch shaft body is moved to the point P required to move the directional switch. In this case, the end of the knob 109 occupies the position of Qvrt. When it is assumed that a line II-II is a predetermined reference line, the distances between the ends Q and Qvrt of the knob 109 for each case and the line II-II are indicated by L1 and L2, and the following relationship is satisfied: L1>L2 (L1−L2=L3>0).

In other words, the lower arrangement structure of the switch shaft hinge minimizes the directional tilting angle required to move the directional switch 560 to minimize the movement distance of the knob 109 toward the housing unit and thus minimize the spaced distance between the knob 109 and the housing cover of the housing unit so that a possibility of introduction of foreign substances into the direction switch unit through the housing cover can be reduced and a compact structure can be implemented.

The rotary switch unit 400 detects the axial rotation of the switch shaft unit 300 and outputs a signal indicating the detection of the axial rotation for application to an external device such as a control unit (not shown). The rotary switch unit 400 includes a rotary encoder 410 and a rotary switch sensor 420. The rotary encoder 410 is disposed between the substrate 20 and the housing base 130 of the housing unit 100, and has a structure in which it at least partially receives the switch shaft hinge 320 of the switch shaft unit 300. In other words, the rotary encoder 410 includes a rotary encoder receiving part 411. The rotary encoder receiving part 411 is a space formed at the center of the rotary encoder 410 and defines a mounting space together with the housing holder 120 disposed above the rotary encoder 410 to allow the switch shaft hinge 320 to be seated therein.

The rotary encoder 410 includes a rotary encoder receiving guide 413 formed on the inner periphery thereof to partition the rotary encoder receiving part 411 inside the rotary encoder 5410. The switch shaft hinge 320 of the switch shaft unit 300 includes a shaft hinge guide 321 formed on the outer periphery thereof so that the shaft hinge guide 321 is receivingly disposed in the rotary encoder receiving guide 413.

The rotary encoder receiving guide 413 and the shaft hinge guide 321 have a structure in which they are engaged with each other to prevent a relative axial rotation thereof. In this embodiment, the rotary encoder receiving guide 413 and the shaft hinge guide 321 have a structure in which a predetermined relative movement thereof along the axial direction thereof, i.e., an axial longitudinal direction of the switch shaft body 310 is permitted. In other words, the rotary encoder receiving guide 413 has a rectangular structure in an axial longitudinal direction in a state in which an external force is not applied to the switch shaft body 310 so that an axial longitudinal direction length of a rotary shaft of the rotary encoder 410 is larger than a circumferential direction length of the rotary encoder 410. When it is assumed that the circumferential direction length of the rotary encoder 410 of the rotary encoder receiving guide 413 is a horizontal length A and the axial longitudinal direction length of the rotary shaft of the rotary encoder 410 is a longitudinal length B, the aspect ratio (AR=B/A) is set to have a value larger than 1.

The rotary encoder 410 has a plurality of rotary encoder slits 415 formed on the outer periphery thereof. The rotary switch unit 400 includes a rotary switch sensor 420 disposed at a position corresponding to the rotary encoder slits 415. In other words, the rotary switch sensor 420 is implemented as an optical sensor and is disposed on an underside of the substrate 200. The rotary encoder slits 415 at the end of the rotary encoder 410 are movably disposed at a position corresponding to the rotary switch sensor 420 so that the rotary switch sensor 420 can detect the rotation state of the rotary encoder 410 performing the axial rotation together with the switch shaft unit 300 based on the number of movements of the rotary encoder slits 415, and transmits a signal indicating the detection of the rotation state of the rotary encoder 410 to the external device via the substrate 200.

The rotary switch unit 400 may include an constituent element for detenting the rotation of the switch shaft unit 300 and the rotary encoder 410 so as to prevent an undesirable rotation of the rotary switch unit 400 as well as an erroneous operation in setting the operation states of devices of a vehicle through the rotation operation of the switch shaft unit by generating a more accurate rotation signal. That is, the rotary switch unit 400 of the present invention includes a rotary dent unit 430. The rotary detent part 430 includes a rotary detent 431, a rotary detent ball 433, and a rotary detent elastic means 435. The housing base 130 of the housing unit 100 includes a rotary detent receiving part 131 formed therein. The rotary detent elastic means 435 is receivingly disposed at the rotary detent receiving part 131.

The rotary detent 431 is disposed on the underside of the rotary encoder 410. The rotary detent 431 may be formed as a separate element and then mounted on the underside of the rotary encoder 410, it has a structure which is formed integrally on the underside of the rotary encoder 410 in this embodiment. The rotary detent 431 is implemented as a plurality of prominences and a plurality of depressions which are alternately arranged with each other in this embodiment, and may have a structure in which the prominences and the depressions are arranged spaced apart from each other at predetermined intervals, respectively. Although not shown in this embodiment, the rotary switch unit 400 may have a structure in which it further includes a rotary stopper (not shown) for preventing the excessive rotation of the rotary encoder to form a rotation restriction region, if necessary. In addition, the rotary switch unit 400 may be modified in various manners, such as having a structure of performing infinite rotation without restriction of rotation and initializing a rotation reference upon the turning off of the power switch.

The rotary detent receiving part 131 is formed at a position corresponding to the rotary detent 431, and the rotary detent elastic means 435 of a coil spring structure is disposed at the rotary detent receiving part 131. The rotary detent elastic means 435 elastically supports the rotary detent ball 433 to maintain a continuous contact with the rotary detent 431. Although the rotary detent elastic means has been implemented as a coil spring in this embodiment, it may be implemented as a spiral-type leaf spring and may be modified in various manners within a range of implementing a rotary detenting operation, such as performing a detenting operation through the contact between the a punched protrusion of the leaf spring and the rotary detent.

Meanwhile, in the case where a force is applied to the switch shaft body 310 of the switch shaft unit 300 to cause the switch shaft body 310 to be laterally moved relative to the switch shaft hinge 320 to perform a direction operation of the switch shat unit 300, the directional switch unit 500 detects a movement of the switch shaft body 310 to one direction on a plane parallel with the substrate 200 when it is viewed from the plane parallel with the substrate 200 due to the tilting operation of the switch shaft unit 300, and output a signal indicating the detection of the movement of the switch shaft body 310.

The directional switch unit 500 includes a directional slide part 510, a directional switch 560, and a directional return part 550. The directional slide part 510 can be changed in position within the housing unit 100 by the tilting directional operation of the switch shaft unit 300. The directional slide part 510 performs a movement operation on a plane parallel with the substrate so that the directional tilting movement of the directional switch unit 500 can be performed in which the tilting movement of the switch shaft unit can be converted into a planar movement of the directional switch unit 500 on the plane parallel with the substrate.

The directional switch 560 is disposed on the substrate 200, and is operated by a change in the position of the directional slide part 510 to generate a signal indicating the change in the position of the directional slide part 510. In this embodiment, the directional switch 560 is implemented as a contact switch, but may be modified depending on a design specification.

The directional switch 560 is disposed on a top surface of the substrate 200 so as to be oriented toward the housing cover 110. The directional switch 560 takes a structure in which it is movably disposed at an upper portion of the housing holder 120, which is divided relative to the housing holder 120.

Meanwhile, the directional slide part 510 in accordance with the present invention includes a directional top slide 520, a directional medium slide 530, and a directional bottom slide 540. The directional medium slide 530 is disposed between the housing base 130 and the housing cover 110, more specifically, between the housing cover 110 and the housing holder 120. The directional medium slide 530 has a medium through-hole 533 formed at the center thereof to allow the switch shaft body 310 of the switch shaft unit 300 to penetrate therethrough.

In addition, the directional medium slide 530 has a medium side 535 formed at a side thereof. The medium side 535 has a groove formed at a side of the directional medium slide 530 so that an interference with an element of the directional return part which will be described later can be excluded.

Figure 13:
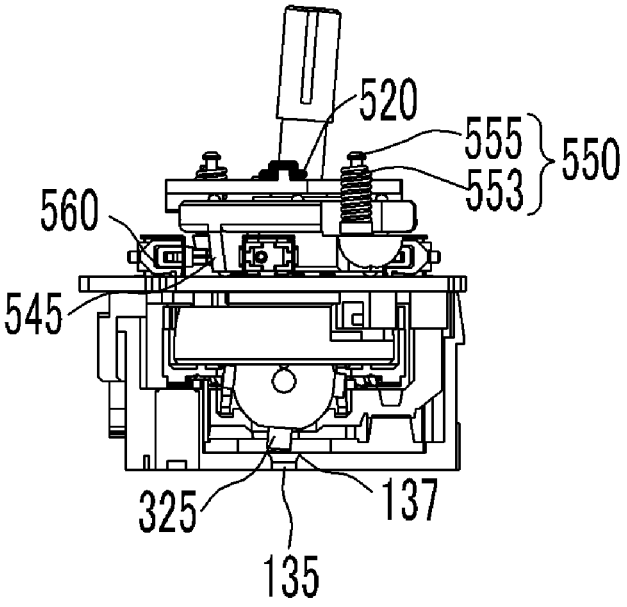
FIG. 13 is a schematic partial side view illustrating the directional tilting operation state of a multi-operating switch device for a vehicle according to an embodiment of the present invention.
Figure 14:
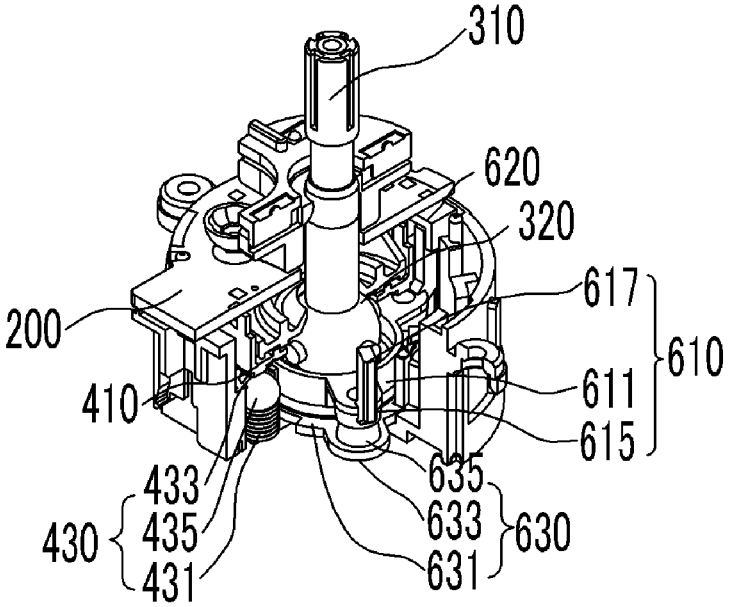
FIG. 14 is a schematic partial cut-away perspective view illustrating a multi-operating switch device for a vehicle according to an embodiment of the present invention.
Figure 15:
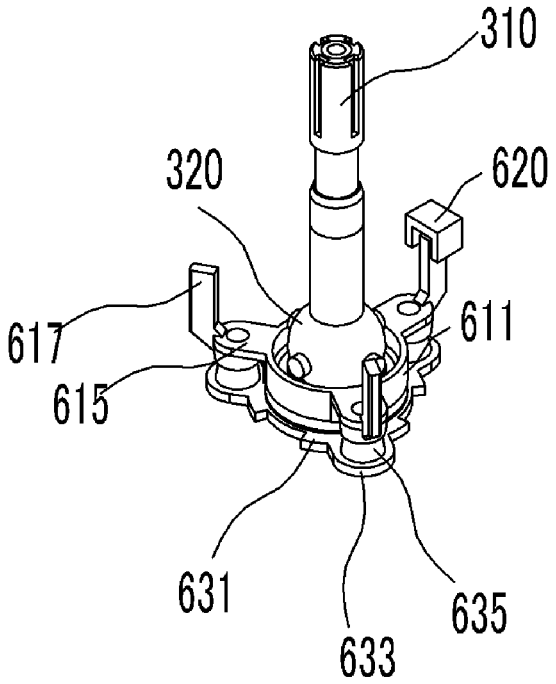
FIG. 15 is a schematic partial perspective view illustrating a push switch unit of a multi-operating switch device for a vehicle according to an embodiment of the present invention.

The directional medium slide 530 has a predetermined plate structure, and includes a medium upper guide 531 and a medium lower guide 537. The medium upper guide 531 is formed on one surface of the directional medium slide 530 so as to be oriented toward the housing cover 110. The medium lower guide 537 is formed on the other surface of the directional medium slide 530 so as to be oriented toward the housing holder 120. The directional top slide 520 (see a dotted line indicated in FIG. 13) is formed on one surface of the housing cover 110 so as to be oriented toward the directional medium slide 530 and is engaged with the directional medium slide 530 in a relatively movable manner. The directional top slide 520 is engaged with the medium upper guide 531 of the directional medium slide 530 to form a relatively movable structure so that the directional medium slide 530 can be moved on a horizontal plane in the lengthwise direction of the medium upper guide 531 and the directional top slide 520 within the housing unit 100.

In this embodiment, the directional top slide 520 is formed in a recessed shape and the medium upper guide 531 is formed in a projected shape. The directional top slide 520 and the medium upper guide 531 may be modified in various manners, such as taking a configuration in which they are formed in a reverse shape.

Further, the directional medium slide 530 has the medium lower guide 537 formed on the other surface, i.e., the underside thereof. The medium lower guide 537 is engaged with a bottom guide 541 formed on the directional bottom slide 540 in a relatively movable manner. In this embodiment, the medium lower guide 537 is formed as a projected structure and the bottom guide 541 is formed as a recessed structure, but vice-versa.

The directional bottom slide 540 includes a bottom slide body 544, a bottom slide side 547, and a bottom slide moving part 545. The bottom slide body 544 includes the bottom guide 541 formed on one surface thereof, and has a bottom through-hole 542 formed at the center thereof. The bottom through-hole 542 has a structure in which it forms a cocentrical structure together with the medium through-hole 533, but the inner diameter of the bottom through-hole 542 is smaller than that of the medium through-hole 533. The inner diameter of the bottom through-hole 542 has a value that is approximate to the outer diameter of the switch shaft body 310 so that the inner peripheral surface of the bottom through-hole 542 comes into close contact with the outer peripheral surface of the switch shaft body 310, and thus the directional bottom slide 540 can perform the directional tilting operation in which the directional bottom slide 540 is moved on a horizontal plane upon the tilting movement of the switch shaft unit 300

The bottom slide body 544 may have a bottom slide lug 543 formed on one surface thereof to form a point-contact structure which minimizes a contact area with the directional medium slide 530 disposed on the top surface thereof to reduce a contact resistance. Although the directional bottom side takes a structure in which a projected structure is formed at the bottom slide body in this embodiment, various modifications can be possible such as taking a structure in which the projected structure is formed at the directional medium slide.

The bottom slide side 547 has a structure in which it is formed extending outwardly from a side of the bottom slide body 544. The bottom slide side 547 may a structure in which it is formed separately from the bottom slide body 544 so as to be engaged with the bottom slide body, if necessary. The bottom slide side 547 is formed at a position corresponding to the medium side 535. The return groove 557 which will be described later is formed in the bottom slide side 547.

Figure 16:
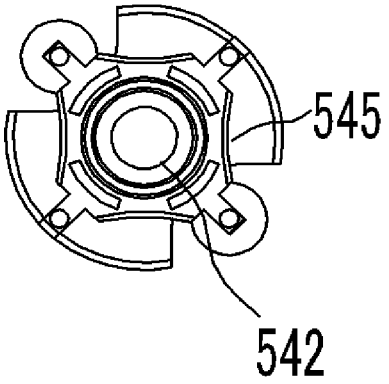
FIG. 16 is a bottom view illustrating a directional bottom slide of a multi-operating switch device for a vehicle according to an embodiment of the present invention.

The bottom slide moving part 545 is formed below the bottom slide body 544. In the case where the directional bottom slide 540 performs the directional tilting operation, the bottom slide moving part 545 can move directional switches 560 equidistantly arranged radially on the substrate 200 so as to be positioned adjacent to the bottom through-hole 542. In this embodiment, the directional switches 560 are implemented as contact switches. The bottom slide moving part 545 is forms a projected structure that enables a contact with the directional switches 560. In this embodiment, the number of the directional switches 560 provided is four. The bottom slide moving part 545 is formed as a projected square structure having four movable faces correspondingly to the directional switches 560 so that respective allocated movable faces of the bottom slide moving part 545 forms a contact with the directional switches 560 to generate a signal indicating the change in the position of the directional switches 560. More specifically, as shown in FIG. 16, the bottom slide moving part 545 is formed on the underside of the directional bottom slide 540. The bottom slide moving part 545 is formed as a projected square structure, but may be formed as a structure having a predetermined inwardly arcuate shape so as to perform a smooth operation upon the contact between the bottom slide moving part 545 and the directional switches 560 and prevent durability of the directional switches from being degraded through a stable contact and separation operation upon the directional operation.

The directional tilting movement of the directional slide part 510, i.e., a horizontal sliding movement on a horizontal plane by the tilting movement of the switch shaft unit can be carried out through the relative movement of the directional top slide, the directional medium slide, and the directional bottom slide, i.e., a relative movement between the directional top slide and the medium upper guide and between the medium lower guide and the bottom guide. In this embodiment, the medium upper guide and the medium lower guide have a structure in which they are arranged so as to cross each other at 90 degree angles on the same plane when viewed from the top by projection so that the movement to any position on the horizontal plane of the directional tilting movement can be performed.

In the meantime, as described above, the directional switch unit 500 includes a directional return part 550. The directional return part 550 returns the directional slide part 510 and the switch shaft unit 300 to their original positions after an external force applied to the switch shaft unit is removed. The directional return part 550 includes a return elastic part 553, a return plunger 555, and a return groove 557. The return plunger 555 is movably disposed in the housing unit 100. In other words, the housing cover 110 of the housing unit 100 includes a return mounting part 551 formed thereon. The return plunger 555 is movably disposed at the return mounting part 551. The return plunger 555 is formed in a rod shape, and an end thereof is oriented toward the return groove 557. The return elastic part 553 is disposed in the return mounting part 551 where the return plunger 555 is disposed. The return elastic part 553 is supported at one end thereof by the inner surface of the return mounting part 551 and is in close contact at the other end thereof with the outer peripheral surface of the return plunger 555 so as to elastically support the return plunger 555 with respect to the housing cover 110.

The return groove 557 forms a continuous contact with the return plunger 555. In the case of a normal state in which the external force applied to the switch shaft unit is removed, the interaction between the return plunger 555 and the return elastic part 553 returns the return plunger 555 to its original position and thus ultimately return the directional slide part 510 to its original position. The return plunger 555 is elastically supported by the return elastic part 553 so that it can be moved in an axial direction in parallel with an axial longitudinal direction of the switch shaft body 310 of the switch shaft unit 300 in the return mounting part 551 of the housing unit 100. The return groove 557 is formed at the bottom slide side 547 of the directional bottom slide 540.

The return groove 557 includes a groove stable portion 558 and a groove moving portion 559. The groove stable portion 558 forms a contact with a lower end of the return plunger 555 in a normal state in which no external force is applied to the switch shaft body 310. The groove moving portion 559 is disposed at the outside of the groove stable portion 558 so that when an external force is applied to the switch shaft body 310 of the switch shaft unit 300 to cause the switch shaft body 310 to be moved in a transverse direction from the center thereof, the groove moving portion 559 forms a contact with the lower end of the return plunger 555.

By virtue of this simple operation of the directional return part 550, when an external force perpendicular to the lengthwise direction of the switch shaft body 310 is applied to the switch shaft body 310 and then is removed, the switch shaft body 310 can stably return to its original position.

The push switch unit 600 of the present invention detects a pressure type push operation of the switch shaft unit 300. The push switch unit 600 includes a push holder 610, a push switch 620, and a push return part 630.

The push holder 610 is at least partially disposed below the rotary encoder 410 and is configured to be in close contact with the switch shaft hinge 320 of the switch shaft unit 310 so that when the switch shaft unit 300 is vertically moved, the push holder 610 is vertically moved together with the switch shaft unit 300. The push switch 620 may be implemented as an optical sensor. Although it has been described in this embodiment that the push switch 620 is implemented as the optical sensor, it may be modified in various manners, such as being implemented as a non-contact type magnetic sensor switch and magnet structure, if necessary.

When the push holder 620 is changed in position in a vertical direction, the push switch 620 generates a signal indicating the change in the position of the push switch 620. The push switch 620 is disposed on the underside of the substrate 200 so as to be positioned in proximity to the rotary switch sensor 420. The push return part 630 is disposed below the push holder 610 and elastically supports the push holder 610. When an external force applied to the push holder 610 is released, the push holder 610 returns to its original position.

More specifically, the push holder 610 includes a holder body 611, a holder side extension 615, and a holder moving part 617. The holder body 611 includes a through-hole 613 formed at the center thereof so that a shaft hinge stopper 325 of the switch shaft hinge 320 is penetratingly disposed in the through-hole 613. The holder extension 615 is formed extending outwardly from a side of the holder body 611 so that the holder moving part 617 is disposed on the holder extension 615. The holder moving part 617 is formed upwardly extending from the holder extension 615 in parallel with a vertical movement direction of the switch shaft unit 300 so that when the switch shaft unit 300 is vertically moved, the holder moving part 617 moves the push switch 620. The holder moving part 617 is formed extending upwardly toward the substrate 200. When an external force is not applied to the holder moving part 617, an end of the holder moving part 617 is positioned between a light-receiving unit (not shown) and a light-emitting unit (not shown) of the push switch 620. When a push pressure force is applied to the holder moving part 617 to cause the holder moving part 617 to be moved, the holder moving part 617 is separated from the push switch 620 to generate a predetermined signal indicating a change in the position thereof.

The push switch unit 600 further includes the push return part 630 for returning the push moving part 670 to its original position after the external force applied to the holder moving part 617 is removed. The push return part 630 includes a push return body 631, a push return extension 633, and a push return rubber cap 635. The push return body 631 includes a through-hole 632 formed at the center thereof to have a predetermined ring shape so that the shaft hinge stopper 325 can be vertically moved through the through-hole 632.

The push return extension 633 is formed extending outwardly from the outer periphery of the push return body 621. The push return rubber cap 635 is protrudingly forme upwardly from one surface of the push return extension 633. The push return body, the push return extension, and the push return rubber cap may be modified in various manners, such as being formed integrally with each other, or formed as a mutual engagement structure.

The push return rubber cap 635 elastically supports the holder extension 615 so that a vertical pressing force applied to the push holder 615 is removed to cause the push holder 615 to return its original position.

Figure 5:
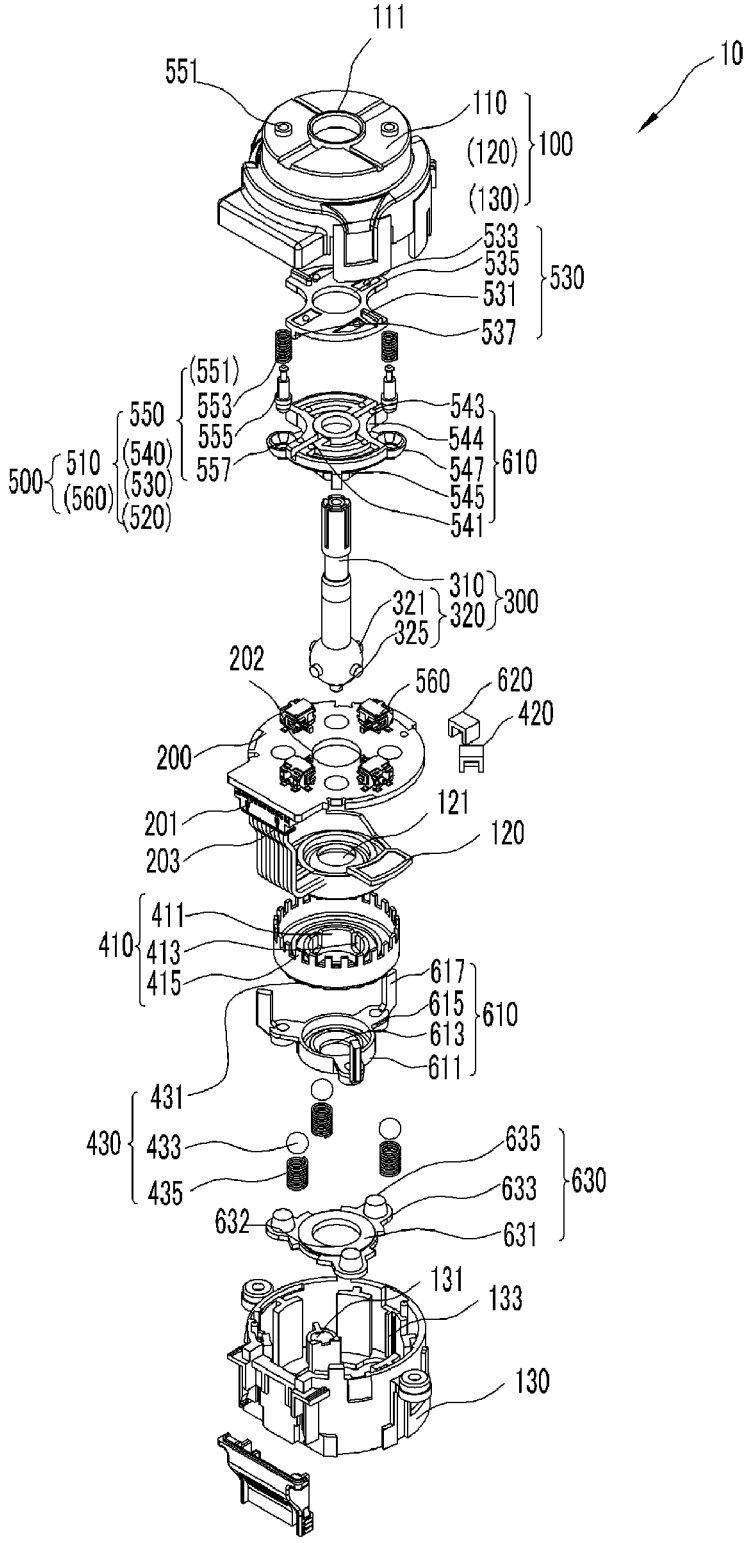
FIG. 5 is a schematic exploded perspective view illustrating a multi-operating switch device for a vehicle according to an embodiment of the present invention.
Figure 6:
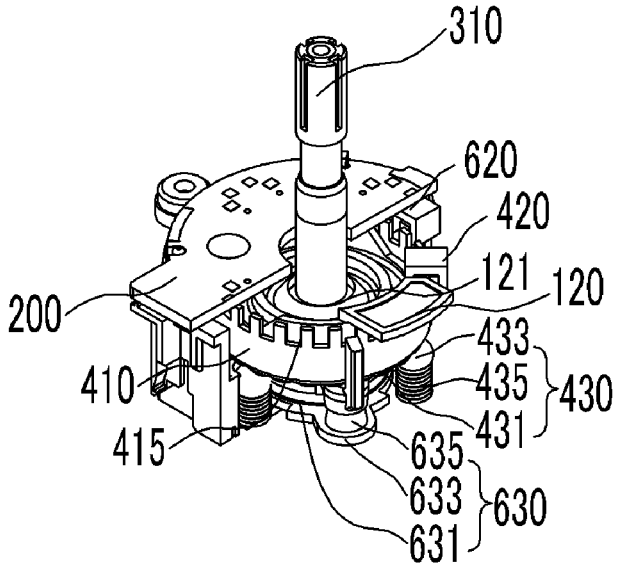
FIG. 6 is a schematic partial cut-away perspective view illustrating a multi-operating switch device for a vehicle according to an embodiment of the present invention.
Figure 7:
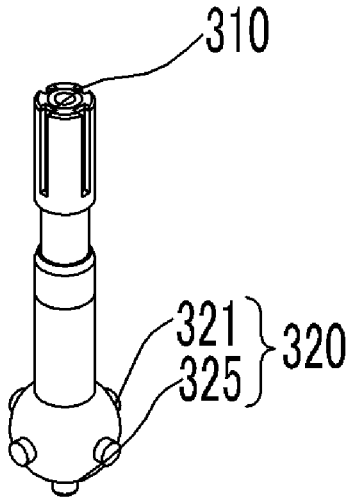
FIG. 7 is a schematic perspective view illustrating a switch shaft unit of a multi-operating switch device for a vehicle according to an embodiment of the present invention.
Figure 8:
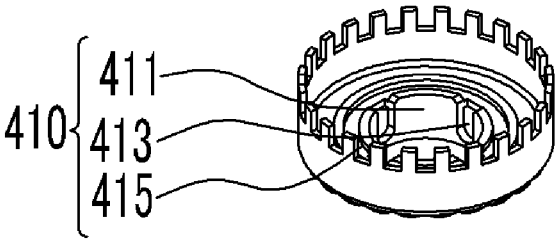
FIG. 8 is a schematic perspective view illustrating a rotary encoder of a multi-operating switch device for a vehicle according to an embodiment of the present invention.
Figure 9:
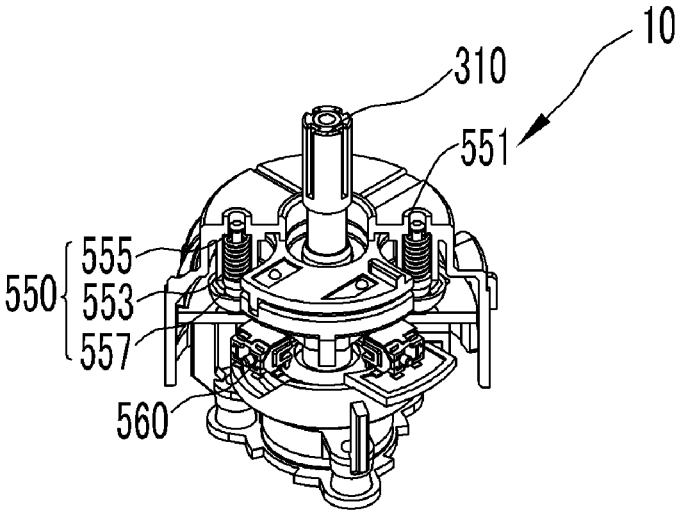
FIG. 9 is a schematic partial cut-away perspective view illustrating a multi-operating switch device for a vehicle according to an embodiment of the present invention.
Figure 10:
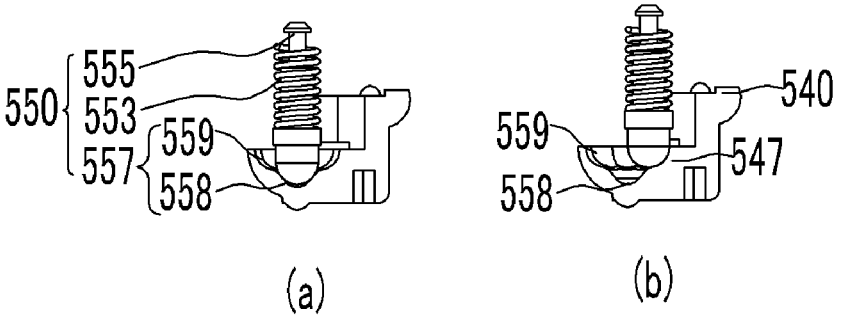
FIG. 10 is a schematic partial cut-away cross-sectional side view illustrating the operation state of a directional return part during a directional tilting operation of a multi-operating switch device for a vehicle according to an embodiment of the present invention.
Figure 11:
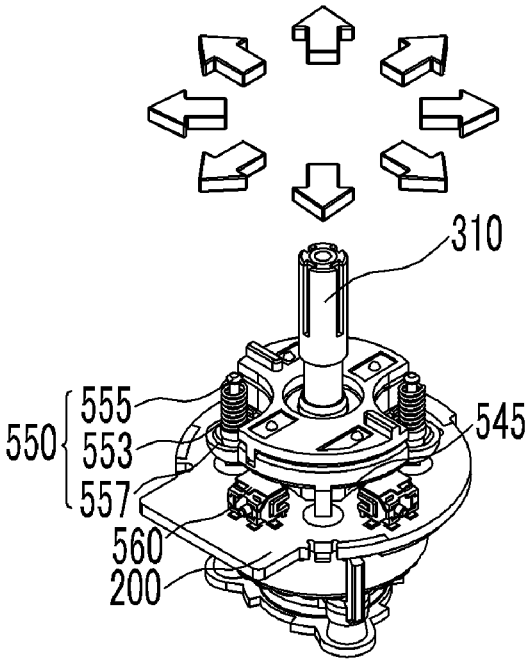
FIG. 11 is a schematic partial perspective view illustrating the operation state of a directional return part during a directional tilting operation of a multi-operating switch device for a vehicle according to an embodiment of the present invention.
Figure 12:
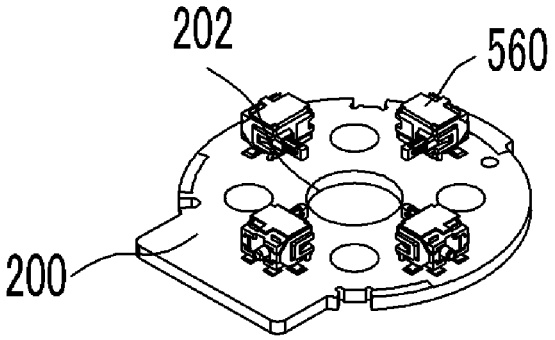
FIG. 12 is a schematic perspective view illustrating the mounting state of a directional switch of a multi-operating switch device for a vehicle according to an embodiment of the present invention.

In addition, in the case where the push holder 615 returns to its original position by the push return part, the housing base 130 may further include a guide element for allowing for a stable original position returning operation of the push holder. In other words, as shown in FIG. 5, the housing base 130 includes a base push guide 133 formed at the inside thereof so that a side end of the holder moving part 617 is insertingly guided along the base push guide 133 to form a stable relative vertical movement structure.

Meanwhile, the housing base may further include a constituent element for preventing interference of an output signal from occurring upon the simultaneous performance of undesirable two operations, for example, the push operation and the directional tilting operation. In other words, the housing base 130 includes a base push tolerance 135 formed on a bottom surface thereof to correspond to a position of the shaft hinge stopper 325, and a base push stopper 137 formed on the outer periphery of the base push tolerance 135. The base push tolerance has a predetermined recessed structure. In the case where a push operation is performed, the base push tolerance 135 allows the shaft hinge stopper 325 disposed at the lower end of the switch shaft hinge 320 to be received therein. On the other hand, in the case where a directional tilting operation is performed, when a pressure push force is applied to the switch shaft body an axial direction thereof, the shaft hinge stopper 325 can be brought into close contact with the base push stopper 137 to prevent the pressure push operation of the switch shaft body.

In the meantime, although it has been described in the above embodiment that the rotary detent part of the rotary switch unit is disposed on the underside of the rotary encoder, a structure of the rotary detent part according to the present invention is not limited thereto. FIGS. 18 to 23 show other embodiments of the multi-operating switch device for a vehicle in accordance with the present invention.

Figure 18:
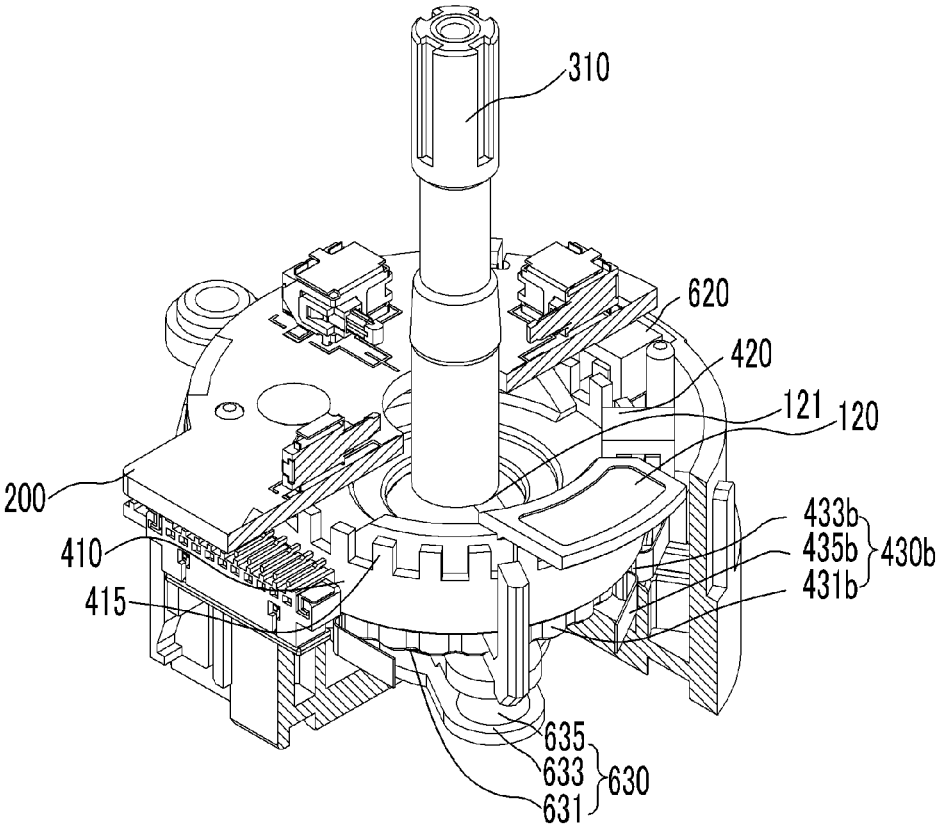
FIGS. 18 and 19 respectively illustrate a modification of a rotary detent part.
Figure 19:
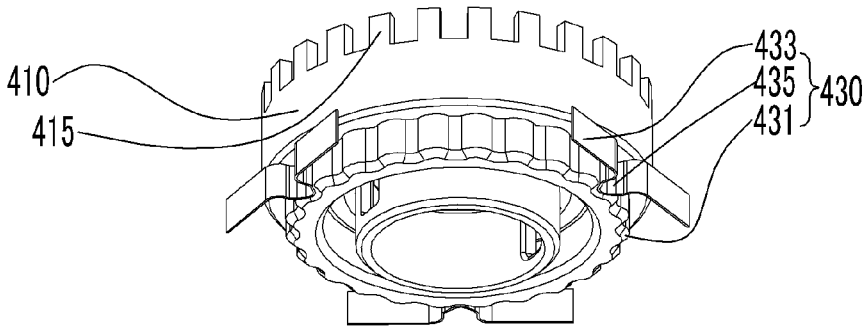
Figure 20:
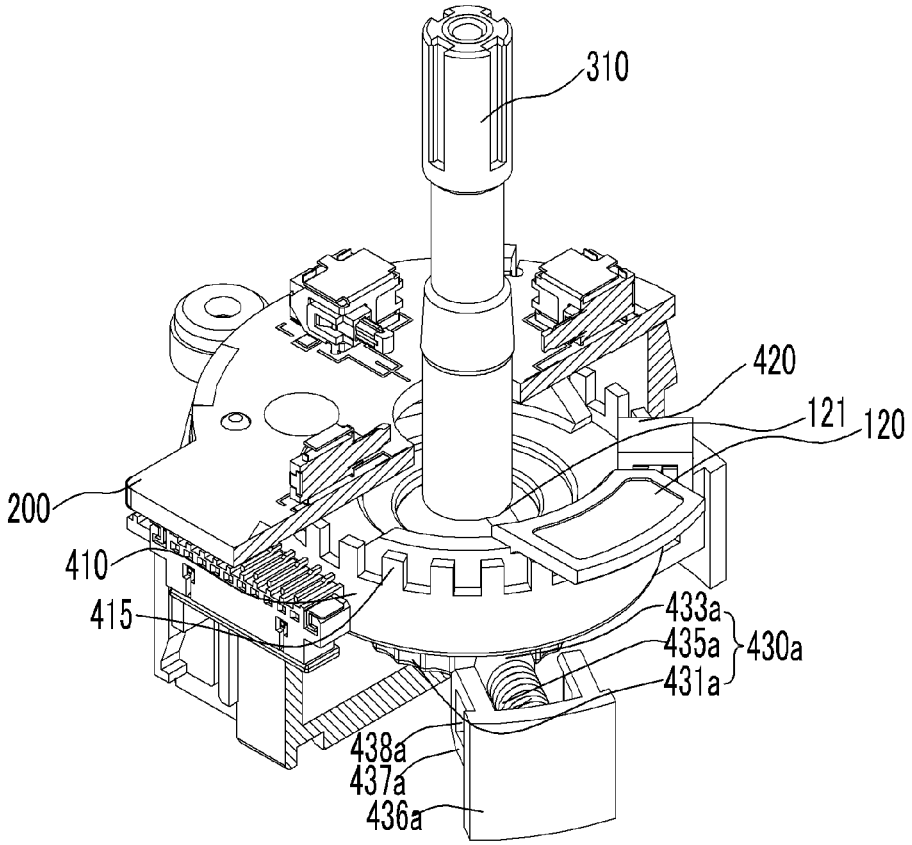
FIGS. 20 to 23 respectively show another modification of a detenting operation performed for the rotation of the rotary encoder at a side of a lower portion of the multi-operating switch device for a vehicle of the present invention.
Figure 21:
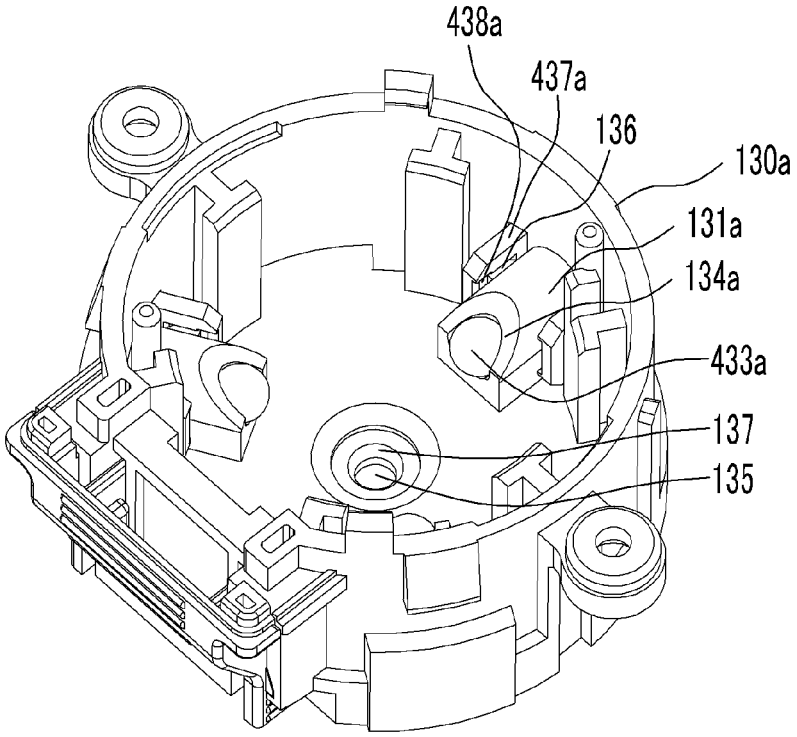

FIGS. 18 and 19 illustrate a modification of a rotary detent part 430*b*. That is, the rotary detent part 430*b* has a structure in which it is detented at a side of a lower portion of the rotary encoder 410 unlike the previous embodiment. The rotary detent part 430*b* includes a rotary detent 431, a rotary detent elastic means 433, and a rotary detent elastic protrusion 435. The rotary encoder 410 is the same as in the previous embodiment, but the rotary detent 431 has a structure in which it is disposed at side of a lower portion of the rotary encoder 410. The rotary detent is formed as a structure in which one or more prominences and depressions are arranged spaced apart from each other at predetermined intervals, respectively. The rotary detent elastic means 433 is disposed in the housing base 130 of the housing unit 100. The rotary detent elastic means 433 is implemented as a leaf spring. In other words, the rotary detent elastic means 433 is formed as an elastic piece having a predetermined elastic force, such as a metal plate. The rotary detent elastic protrusion 435 is formed integrally with the rotary detent elastic means 433, so as to be bently protruded from the center of the rotary detent elastic means 433 to maintain a continuous contact with the rotary detent 431.

The rotary detent elastic means 433 and the rotary detent elastic protrusion 435 are provided in single number or plural numbers, respectively. In this embodiment, the rotary detent elastic means 433 and the rotary detent elastic protrusion 435 take a structure in which three rotary detent elastic means 433 and three rotary detent elastic protrusions 435 are respectively arranged at equal angles on a plane parallel with the rotary shaft of the rotary encoder so as to perform a smooth detenting operation and form a stable support state without being tilted to one side upon the rotation of the rotary encoder 410.

In addition, FIGS. 20 to 23 show another modification of a detenting operation performed for the rotation of the rotary encoder at a side of a lower portion of the multi-operating switch device for a vehicle of the present invention. The rotary encoder 410 includes a plurality of rotary encoder slits 415 formed on the outer periphery thereof and the rotary switch sensor 420 is disposed at a position corresponding to the rotary encoder slits 415.

A rotary detent part 430*a* detents the rotation of the switch shaft unit 300 and the rotary encoder 410 so as to prevent an undesirable rotation of the rotary switch unit 400 as well as an erroneous operation in setting the operation states of devices of a vehicle through the rotation operation of the switch shaft unit by generating a more accurate rotation signal, and provide a sense of manipulation. The rotary detent part 430*a* includes a rotary detent 431*a*, a rotary detent ball 433*a*, and a rotary detent elastic means 435*a*.

The housing base 130 of the housing unit 100 include rotary detent receiving part 131*a*; 132*a*. The rotary detent receiving part 131*a*; 132*a* is formed radially at a side of a lower portion of the housing base 130. A detent holder 436*a* is insertingly disposed at the rotary detent receiving part 131*a*; 132*a*. The rotary detent elastic means 435*a* is brought into close contact at one end thereof with the rotary detent receiving part 131*a*; 132*a*, more specifically, the inside of the detent holder 436*a*, and is brought into close contact at the other end thereof with the rotary detent ball 433*a*. The rotary detent elastic means 435*a* provides a certain elastic force to the rotary detent ball 433*a* to maintain a continuous contact between the rotary detent ball 433*a* and the rotary detent 431*a*.

In other words, the rotary detent receiving part 131*a*;132*a* includes a rotary detent receiving part holder through-hole 132*a* and a rotary detent receiving part guide 131*a*. The rotary detent receiving part guide 131*a* is formed on the inner surface of a lower side portion of the housing base 130, and the rotary detent receiving part holder through-hole 132*a* is formed on the outside of the rotary detent receiving part guide 131*a* at the lower side portion of the housing base 130 so as to penetrate through the housing base 130. The detent holder 436*a* includes a detent holder mounting part 437*a*. The detent holder mounting part 437*a* is inserted into the rotary detent receiving part holder through-hole 132*a* so that the detent holder 346*a* can be maintained in a stable mounting state with respect to the housing base 130.

The rotary detent receiving part guide 131*a* has a tubular structure which is formed extending radially toward the center of the housing base 130. The rotary detent receiving part guide 131*a* is formed as a structure in which both ends thereof are opened so that an insertion and assembly process of the rotary detent elastic means 435*a* can be facilitated, and a stable pressing operation of the rotary detent elastic means 435*a* can be performed. The rotary detent receiving part guide 131*a* at least partially receives the rotary detent ball 433 so that a stable operation state can be maintained through the continuous contact between the rotary detent ball 433 and the rotary detent 431*a* formed at a side of a lower portion of the rotary encoder 410. The rotary detent receiving part guide 131*a* has a guide protrusion 136 formed on the outer peripheral surface thereof, and the detent holder mounting part 437*a* of the detent holder 436*a* includes a detent holder mounting receiving part 438*a*. The guide protrusion 136 is engaged with the detent holder mounting receiving part 438*a* so that the detent holder 346*a* can be prevented from undesirably escaping from the housing base 130.

The detenting structure will be described in further detail. The rotary detent 431 has structure in which it is formed at a side of the lower portion of the rotary encoder 410, more specifically, on the outer peripheral surface of the lower portion of the encoder 410, which is perpendicular to a radial direction from the rotation center of the rotary encoder 410. The rotary detent 431 may have a structure in which the prominences and depressions are arranged spaced apart from each other at predetermined intervals, respectively.

Although not shown in this embodiment, the rotary switch unit 400 may have a structure in which it further includes a rotary stopper (not shown) for preventing the excessive rotation of the rotary encoder to form a rotation restriction region, if necessary. In addition, the rotary switch unit 400 may be modified in various manners, such as having a structure of performing infinite rotation without restriction of rotation and initializing a rotation reference of the rotary switch sensor upon the turning off of the power switch.

Meanwhile, if the rotary detent part is formed as a radially arranged structure, it may additionally implement a push return function. That is, in this case, in another embodiment of the present invention, the push switch unit may be configured as a simpler structure, and may be formed integrally with the push switch unit.

In the previous embodiment, the push switch unit 600 includes a push holder 610, a push switch 620, and a push return part 630. In this embodiment, the push switch unit includes a push switch, a push moving part, and a push detent. The push switch unit may have a structure in which the return function of the push return part in the previous embodiment is performed by the rotary detent part together with the push detent, and the rotary encoder slits (or protrusions) performs a function of the push moving part and the rotary switch sensor performs a switching detection function of a push switch.

In other words, in the case where the push moving part is disposed at the rotary encoder, particularly, on a top end of the rotary encoder and the switch shaft hinge of the switch shaft unit presses the rotary encoder so as to be moved downwardly, the switch shaft hinge is moved downwardly together with the rotary encoder to generate a signal change of the push switch disposed on the substrate. In this embodiment, the rotary encoder slits function as the push moving part, and the rotary switch sensor functions as the push switch.

The push detent 630*a* is formed on an upper end of the rotary detent 431*a* at a side of the lower portion of the rotary encoder 410*a*. The push detent 630*a* forms a stacked-layer structure together with the rotary detent 431*a* in a longitudinal direction of the switch shaft unit 300 and a radial direction from the center of the switch shaft unit 300. In other words, when it is viewed from a plane through which the rotary shaft of the switch shaft unit 300 penetrates, a plane on which the push dentent 630*a* is disposed and a plane on which the rotary detent 431*a* is disposed are different from each other. That is, the plane on which the push dentent 630*a* is disposed is nearer to the housing cover 110 than that on which the rotary detent 431*a* is disposed.

In this embodiment, the rotary switch sensor 420 can additionally perform a function of the push switch. When the switch shaft unit 300 is vertically pressed by the push operation, a change in the position of the rotary encoder slits functioning as the push moving part causes a change in the signal from the rotary switch sensor. In this case, because a change in the on/off period of the signal by the push operation differs from that in the on/off period of the signal by a typical rotary operation, a configuration may be implemented in which an input state is detected based on the difference therebetween. However, this is merely an embodiment of the present invention, various modifications can be made. Namely, although it has been illustrated in FIGS. 20 to 23 that the push switch unit and the rotary switch unit are integrated, the push switch unit may have a configuration in which the rotary encoder slits 415 causes a change in the signal from the push switch and the push switch is further provided independently of the rotary switch sensor. In addition, the push switch unit may be modified in various manners depending on a design specification, such as having a configuration in which a separate push switch and a separate push moving part are provided independently of the rotary switch sensor and the rotary encoder slits besides the push detent.

By virtue of this configuration, when the switch shaft unit 300 is vertically pressed, the rotary detent ball 433*a* is released from a state in which the rotary detent ball 433*a* is in close contact with the rotary detent 431*a* disposed at a side of the lower portion of the rotary encoder 410*a* which is moved downwardly together with the switch shaft unit 300, and then forms a contact with the push detent 630*a*. In this case, a detent boundary 631*a* is formed between the rotary detent 431*a* and the push detent 630*a* so that a user can easily tactically detect a conversion to the push operation. In other words, the detent boundary 631*a* is interposed between the rotary detent 431*a* and the push detent 630*a* and is formed with a curvature or a protrusion different from that of the both detents so that a user can recognize a tactical change the convention from a normal position to a position by the push operation through the vertical depression.

The push detent 630*a* forms an inclined surface arrangement structure having a predetermined curvature at a side of the lower end of the rotary encoder 410 to an unstable state so that when a vertical pressing force is removed, the push detent 630*a* can be released from a push pressing state by means of a restoring force of the rotary detent part to return to an original position. The push moving part causing the push switch to be moved is at least partially disposed on an upper end of the rotary encoder 410. When the switch shaft hinge of the switch shaft unit presses the rotary encoder to move the rotary encoder downwardly, it is vertically moved together with the rotary encoder. In this embodiment, the present invention takes a configuration in which the function of the rotary encoder slits 415 replace a function of the push moving part, and in which the rotary switch sensor performs a function of the push switch in which the push moving part causes a change in the electrical signal. In other words, the push switch is disposed on the substrate 200. When the push moving part 610*a* is changed in position in a vertical direction, the push switch generates a signal indicating the change in the position of the push moving part 610*a*. As mentioned above, in this embodiment, the push switch is formed integrally with the rotary switch sensor 420. In the case where the push switch is provided independently of the rotary switch sensor, if necessary, the push switch unit may have a configuration in which it is further provided with a separate push switch moving part.

In addition, the rotary detent receiving part guide 131*a* may further include another configuration at an end thereof to prevent unnecessary interference with the rotary encoder and perform a smooth operation during the push operation. In other words, the rotary detent receiving part guide 131*a* includes a chamfered part 134*a* formed at an upper end thereof, which is oriented toward the center of the housing base 130 in such a manner that a top surface of the inner end thereof is chamfered. By virtue of this chamfered part 134*a*, the top surface of the inner end of the rotary detent receiving part guide 131*a* is removed to cause a top surface of the rotary detent ball 433*a* to be at least partially exposed to the outside so that a state can be formed in which the rotary detent ball 433*a* can be brought into close contact with the push detent 630*a* in an easier and smoother manner.

Figure 22:
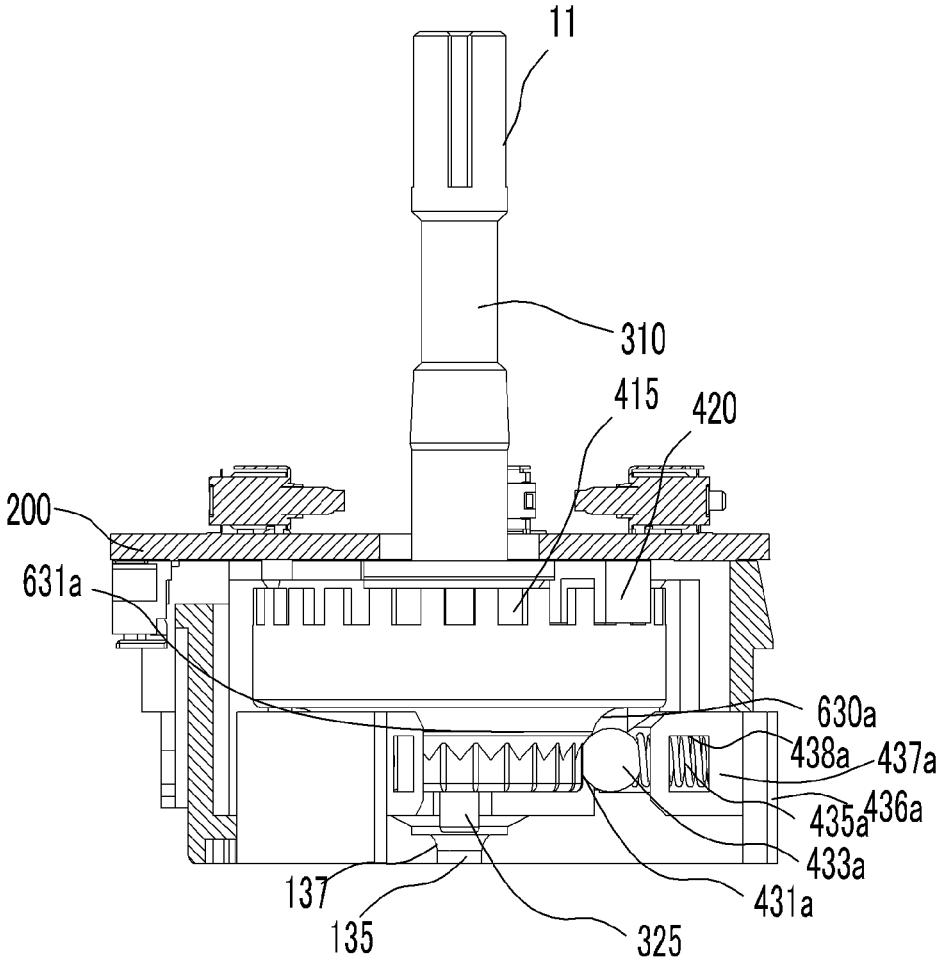
Figure 23:
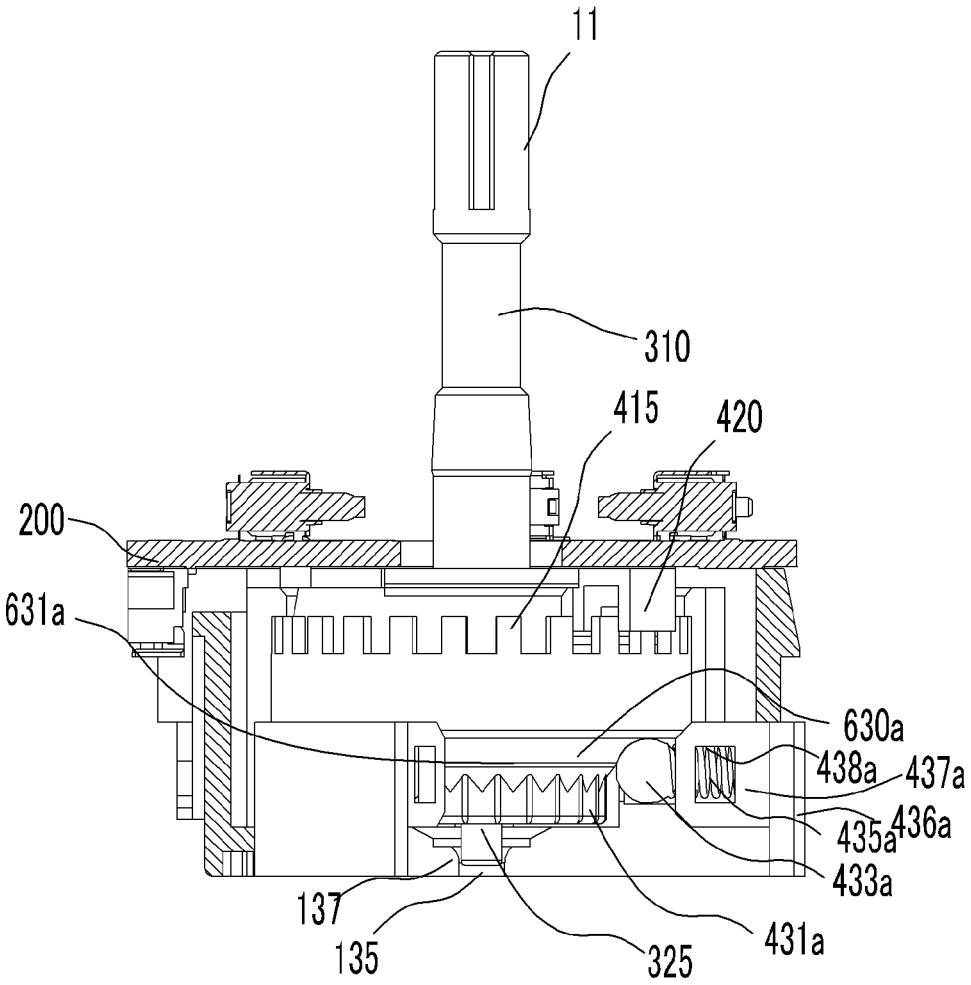

As shown in FIGS. 22 and 23, when a vertical external force is applied to the switch shaft unit, the rotary encoder 420 is vertically moved downwardly and simultaneously the push detent performing the push detenting operation for the vertical movement of the switch shaft unit shares a configuration together with the rotary detent part. Then, the rotary detent ball 433*a* is vertically moved downwardly by the push operation so that it is released from a state of being in close contact with the rotary detent 431 and then is brought into close contact with the push detent 630*a*. In this process, the rotary detent ball 433*a* goes beyond the detent boundary 631*a* to change a contact state so that a certain sense of detent can be endowed to a user.

While the present invention has been described in connection with the exemplary embodiments illustrated in the drawings, they are merely illustrative and the invention is not limited to these embodiments. It will be appreciated by a person having an ordinary skill in the art that various equivalent modifications and variations of the embodiments can be made without departing from the spirit and scope of the present invention. Therefore, the true technical scope of the present invention should be defined by the technical sprit of the appended claims.

INDUSTRIAL APPLICABILITY

The multi-operating switch device for a vehicle in accordance with the present invention can be applied to a wide range of applications, including various electronic devices for performing a combined switching function.

The invention claimed is:

1. A multi-operating switch device for a vehicle, comprising: a housing unit; a substrate disposed within the housing unit; a switch shaft unit movably disposed so as to be received at one end thereof in the housing unit and exposed at the other end thereof to the outside; a rotary switch unit configured to detect the axial rotation of the switch shaft unit and output a signal indicating the detection of the axial rotation; a directional switch unit configured to detect a tilting directional operation of the switch shaft unit and output a signal indicating detection of the tilting directional operation; and a push switch unit configured to detect a pressure type push operation of the switch shaft unit and output a signal indicating the detection of the pressure type push operation, wherein the directional switch unit comprises:

a directional slide part configured to be changed in position within the housing unit by the tilting directional operation of the switch shaft unit;

a directional switch disposed on the substrate, and configured to be operated by a change in the position of the directional slide part to generate a signal indicating the change in the position of the directional slide part; and a directional return switch configured to return the directional slide part and the switch shaft unit to their original positions on a plane, wherein the directional return switch comprises:

a return plunger movably disposed in the housing unit;

a return elastic part received in the housing unit and configured to elastically support the return plunger; and a return groove configured to form a continuous contact with the return plunger and including a position for returning the return plunger to its original position, and wherein the return plunger is movable in an axial direction of the switch shaft unit with respect to the housing unit, and the return groove is formed in the directional slide part.

2. The multi-operating switch device for a vehicle according to claim 1, wherein the housing unit comprises;

a housing base configured to support the substrate; and a housing cover engaged with the housing base to define an inner space therebetween, and including a return mounting part formed thereon to allow the return plunger to be movably disposed at the return mounting part.

3. The multi-operating switch device for a vehicle according to claim 2, wherein the direction slide part comprises:

a directional medium slide disposed between the housing base and the housing cover in such a manner that the switch shaft unit penetrates through the direction medium slide;

a directional bottom slide disposed between the directional medium slide and the housing base in such a manner as to penetratingly fit around the outer periphery of switch shaft unit; and a directional top slide formed on one surface of the housing cover so as to be oriented toward the directional medium slide and configured to be engaged with the directional medium slide in a relatively movable manner.

4. The multi-operating switch device for a vehicle according to claim 3, wherein the directional medium slide comprises:

a medium upper guide formed on one surface thereof so as to be engageable with the direction top slide; and a medium lower guide formed on the other surface thereof so as to be engageable with a bottom guide formed on the directional bottom slide in a relatively movable manner.

5. The multi-operating switch device for a vehicle according to claim 4, wherein the directional bottom slide comprises:

a bottom slide body including the bottom guide formed on one surface thereof, and having a bottom through-hole formed at the center thereof to allow the switch shaft unit to penetrate therethrough in such a manner that the bottom through-hole is in close contact at the inner peripheral surface thereof with the switch shaft unit;

a bottom slide side formed extending outwardly from a side of the bottom slide body and having the return groove formed thereon; and a bottom slide moving part formed below the bottom slide body and configured to move the directional switch.

6. The multi-operating switch device for a vehicle according to claim 5, wherein the medium upper guide and the medium lower guide are arranged so as to cross each other at 90 degree angles on the same plane when viewed from the top by projection.

7. The multi-operating switch device for a vehicle according to claim 5, wherein the return groove comprises:

a groove stable portion configured to form a contact with a lower end of the return plunger in a normal state in which no external force is applied to the switch shaft body; and a groove moving portion is disposed at the outside of the groove stable portion so that when an external force is applied to the switch shaft unit to cause the switch shaft body the groove moving portion forms a contact with the lower end of the return plunger.

8. The multi-operating switch device for a vehicle according to claim 5, wherein the bottom slide moving part is a projection formed protrudingly extending downwardly from the underside of the bottom slide body, and the direction switch is a contact switch.

9. The multi-operating switch device for a vehicle according to claim 1, wherein the switch shaft unit comprises:

a switch shaft hinge disposed at one end thereof so as to be hingeably received within the housing unit and including a shaft hinge guide formed on the outer periphery thereof; and a switch shaft body of a predetermined length connected to the switch shaft hinge and configured to be exposed at one end thereof to the outside from the housing unit, and wherein the rotary switch unit comprises:

a rotary encoder disposed between the substrate and the housing unit and configured to at least partially receive the switch shaft hinge, the rotary encoder including a rotary encoder receiving guide formed on the inner periphery thereof so as to be engageable with the shaft hinge guide and a plurality of rotary encoder slits formed on the outer periphery thereof; and a rotary switch sensor disposed on the substrate so as to be spaced apart from the rotary encoder by a predetermined interval and including a rotary switch sensor configured to detect the number of movements of the rotary encoder slits when the rotary encoder is axially rotated together with the switch shaft unit.

10. The multi-operating switch device for a vehicle according to claim 9, wherein the rotary switch unit further comprises a rotary detent part configured to detent the rotation of the rotary encoder.

11. The multi-operating switch device for a vehicle according to claim 10, wherein the rotary detent part comprises:

a rotary detent disposed on the underside of the rotary encoder;

a rotary detent elastic means received in a rotary detent receiving part disposed in the housing unit; and a rotary detent ball elastically supported by the rotary detent elastic means to maintain a continuous contact with the rotary detent.

12. The multi-operating switch device for a vehicle according to claim 10, wherein the rotary detent part comprises:

a rotary detent disposed on a side of a lower portion of the rotary encoder;

a leaf spring type rotary detent elastic means fixedly mounted to the housing unit to correspond to the rotary detent; and a rotary detent elastic protrusion formed integrally with the rotary detent elastic means so as to be bently protruded from the center of the rotary detent elastic means to maintain a continuous contact with the rotary detent.

13. The multi-operating switch device for a vehicle according to claim 10, wherein the rotary detent part comprises:

a rotary detent disposed on a side of a lower portion of the rotary encoder;

a rotary detent elastic means received in a rotary detent receiving part disposed radially in the housing unit so as to be oriented toward the center of the switch shaft unit; and a rotary detent ball elastically supported by the rotary detent elastic means to maintain a continuous contact with the rotary detent.

14. The multi-operating switch device for a vehicle according to claim 13, wherein the push switch unit comprises:

a push detent disposed on an upper end of the rotary detent at a side of the lower portion of the rotary encoder to form a stacked-layer structure together with the rotary detent in a longitudinal direction of the switch shaft unit and a radial direction from the center of the switch shaft unit;

a push moving part at least partially disposed on the rotary encoder, and configured to be vertically moved downwardly together with the rotary encoder when the switch shaft hinge of the switch shaft unit presses the rotary encoder to downwardly move the rotary encoder; and a push switch disposed on the substrate and configured to generate a signal indicating the change in the position of the push moving part When the push moving part is changed in position in a vertical direction.

15. The multi-operating switch device for a vehicle according to claim 14, wherein the rotary detent receiving part guide further comprises a chamfered part formed at an upper end thereof, which is oriented toward the center of the housing unit to prevent an undesirable interference with the rotary encoder when the rotary encoder is vertically moved.

16. The multi-operating switch device for a vehicle according to claim 9, wherein the push switch unit comprises:

a push holder at least partially disposed below the rotary encoder and configured to be in close contact with the switch shaft hinge of the switch shaft unit so that when the switch shaft unit is vertically moved, the push holder is vertically moved together with the switch shaft unit;

a push switch disposed on the substrate and configured to generate a signal indicating a change in position of the push holder when the push holder is changed in the position in a vertical direction; and a push return part disposed below the push holder and configured to elastically support the push holder.

17. The multi-operating switch device for a vehicle according to claim 16, wherein the push holder comprises:

a holder body configured to contactingly receive the switch shaft hinge;

a holder extension formed extending outwardly from a side of the holder body; and a holder moving part formed upwardly extending from the holder extension in parallel with a vertical movement direction of the switch shaft unit so that when the switch shaft unit is vertically moved, the holder moving part moves the push switch.

18. The multi-operating switch device for a vehicle according to claim 17, wherein the push return part comprises:

a push return body configured to be in close contact with the holder body;

a push return extension formed extending outwardly from a side of the push return body; and a push return rubber cap disposed on one surface of the push return extension and configured to elastically support the holder extension.

19. The multi-operating switch device for a vehicle according to claim 17, wherein each of the holder body and the push return body comprises a through-hole formed at the center thereof, wherein the switch shaft hinge comprises a shaft hinge stopper at a bottom surface thereof, wherein the housing unit comprises a base push tolerance formed at a bottom surface thereof to correspond to the shaft hinge stopper, wherein when an external force is applied to the switch shaft unit to perform a push operation, the shaft hinge stopper is received in the base push tolerance, and wherein when an external force is applied to the switch shaft unit to perform a tilting operation, the shaft hinge stopper is brought into close contact with an outer surface of the base push tolerance to prevent from the shaft hinge stopper being received in the base push tolerance.

* * * * *